US009840104B2

(12) United States Patent
Rueckert et al.

(10) Patent No.: US 9,840,104 B2
(45) Date of Patent: Dec. 12, 2017

(54) SOLVENT RESISTANT PRINTABLE SUBSTRATES AND THEIR METHODS OF MANUFACTURE AND USE

(71) Applicant: Neenah Paper, Inc., Alpharetta, GA (US)

(72) Inventors: Cheryl B. Rueckert, Au Train, MI (US); Aaron Jacobson, Munising, MI (US); Abdu Bunch, Marquette, MI (US); Steven L. Vervacke, Appleton, WI (US)

(73) Assignee: Neenah Paper, Inc., Alpharetta, GA (US)

( * ) Notice: Subject to any disclaimer, the term of this patent is extended or adjusted under 35 U.S.C. 154(b) by 0 days.

(21) Appl. No.: 14/928,539

(22) Filed: Oct. 30, 2015

(65) Prior Publication Data

US 2017/0120655 A1 May 4, 2017

(51) Int. Cl.
*B41M 5/50* (2006.01)
*B41M 5/52* (2006.01)

(52) U.S. Cl.
CPC ..... *B41M 5/5263* (2013.01); *B41M 5/502* (2013.01); *B41M 5/504* (2013.01); *B41M 5/508* (2013.01); *B41M 5/5218* (2013.01); *B41M 5/5227* (2013.01); *B41M 5/5254* (2013.01); *Y10T 428/31993* (2015.04)

(58) Field of Classification Search
CPC ..... B41M 5/502; B41M 5/504; B41M 5/508; B41M 5/5218; B41M 5/5227; Y10T 428/31993
See application file for complete search history.

(56) References Cited

U.S. PATENT DOCUMENTS 5,759,673 A * 6/1998 Ikezawa ..... B41M 5/506 347/105
5,962,149 A 10/1999 Kronzer
6,096,469 A * 8/2000 Anderson ..... B41M 5/52 423/335
6,565,951 B1 * 5/2003 Sugiyama ..... B41M 5/52 428/32.1

(Continued)

FOREIGN PATENT DOCUMENTS

DE 10047157 A1 7/2001
EP 0987120 A1 3/2000

(Continued)

OTHER PUBLICATIONS

International Search Report, dated Dec. 22, 2016.

*Primary Examiner* — Betelhem Shewareged
(74) *Attorney, Agent, or Firm* — Dority & Manning, P.A.

(57) ABSTRACT

A printable substrate, along with methods of its formation, is generally provided. The printable coating can include a base sheet defining a first surface and a second surface and a printable coating on the first surface of the base sheet. The base sheet can be constructed from a cellulosic nonwoven web and a saturant. The printable coating can include a plurality of inorganic microparticles and a crosslinked material, where the crosslinked material is formed from a crosslinkable polymeric binder and a crosslinking agent. An image can be formed on the printable substrate, such as by printing an ink composition onto the printable substrate (e.g., onto the printable coating).

22 Claims, 3 Drawing Sheets

(56) References Cited

U.S. PATENT DOCUMENTS

| | | | | |
|---|---|---|---|---|
| 6,623,817 | B1 | 9/2003 | Yang et al. | |
| 7,199,811 | B2 * | 4/2007 | Goto | G03C 1/79 347/153 |
| 8,586,157 | B2 | 11/2013 | Dolsey | |
| 2002/0005886 | A1 * | 1/2002 | Iwata | B41J 11/002 347/106 |
| 2002/0045035 | A1 | 4/2002 | Nojima et al. | |
| 2002/0119274 | A1 | 8/2002 | Yang et al. | |
| 2003/0054145 | A1 | 3/2003 | Tokunaga et al. | |
| 2004/0109958 | A1 | 6/2004 | Nigam et al. | |
| 2004/0161553 | A1 | 8/2004 | Tsubaki et al. | |
| 2005/0089652 | A1 | 4/2005 | Kasahara et al. | |
| 2006/0028527 | A1 | 2/2006 | Kaga et al. | |
| 2011/0132538 | A1 | 6/2011 | Bonney et al. | |
| 2011/0189477 | A1 | 8/2011 | Miracle et al. | |

FOREIGN PATENT DOCUMENTS

| | | | |
|---|---|---|---|
| EP | 1878588 | A2 | 1/2008 |
| WO | WO 2004/091926 | A1 | 10/2004 |

* cited by examiner

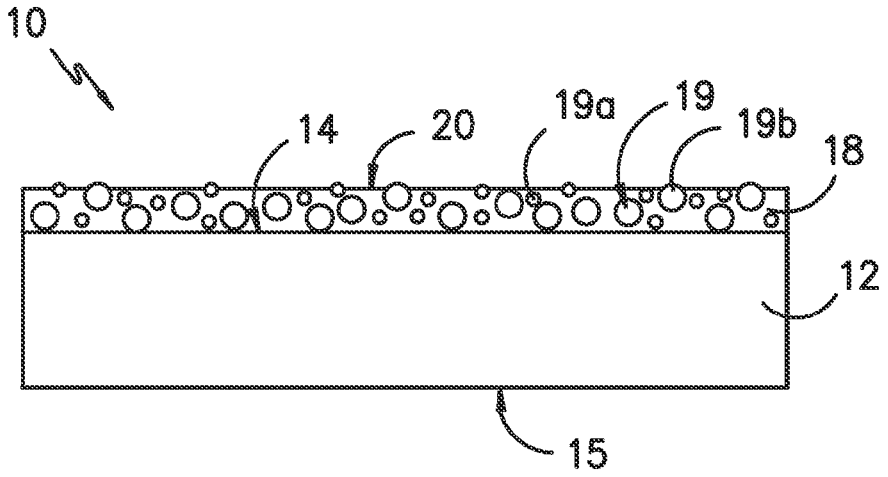
FIG. —1—
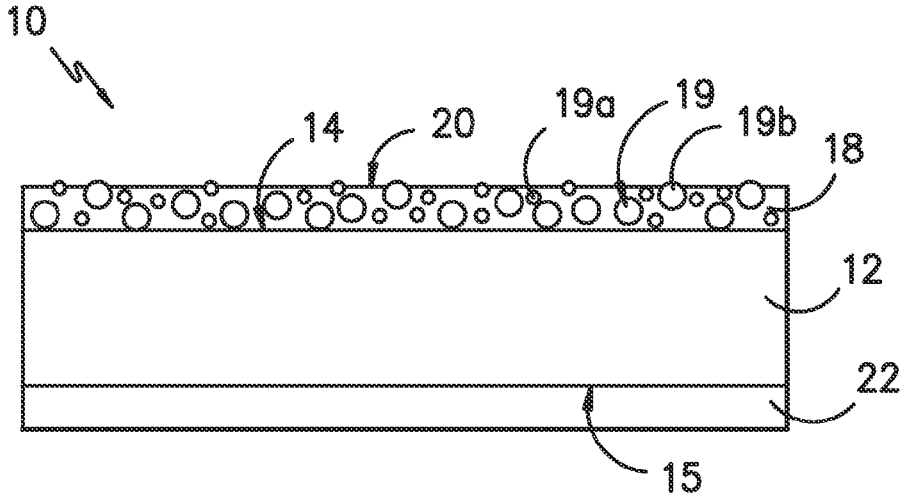
FIG. —2—

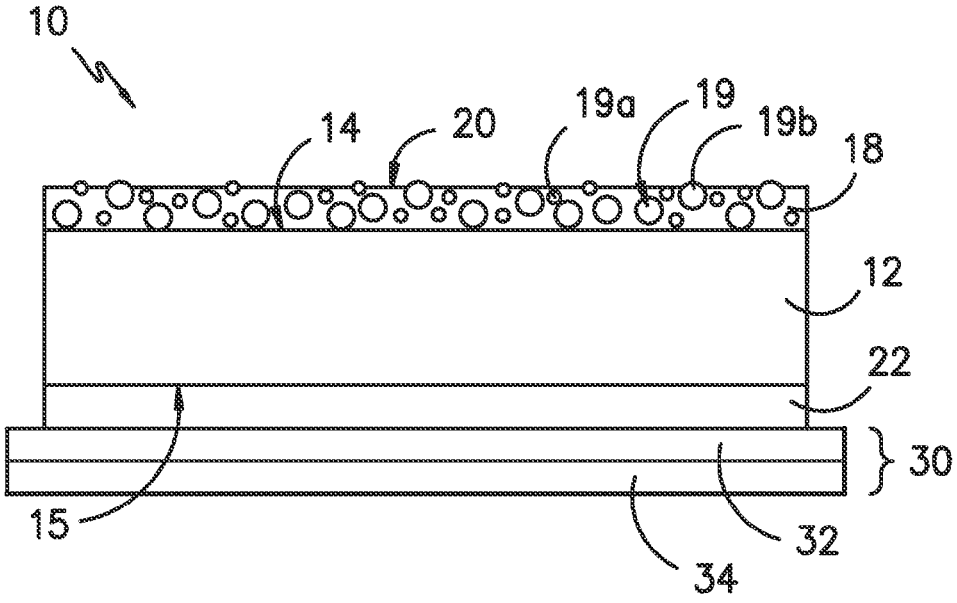
FIG. —3—
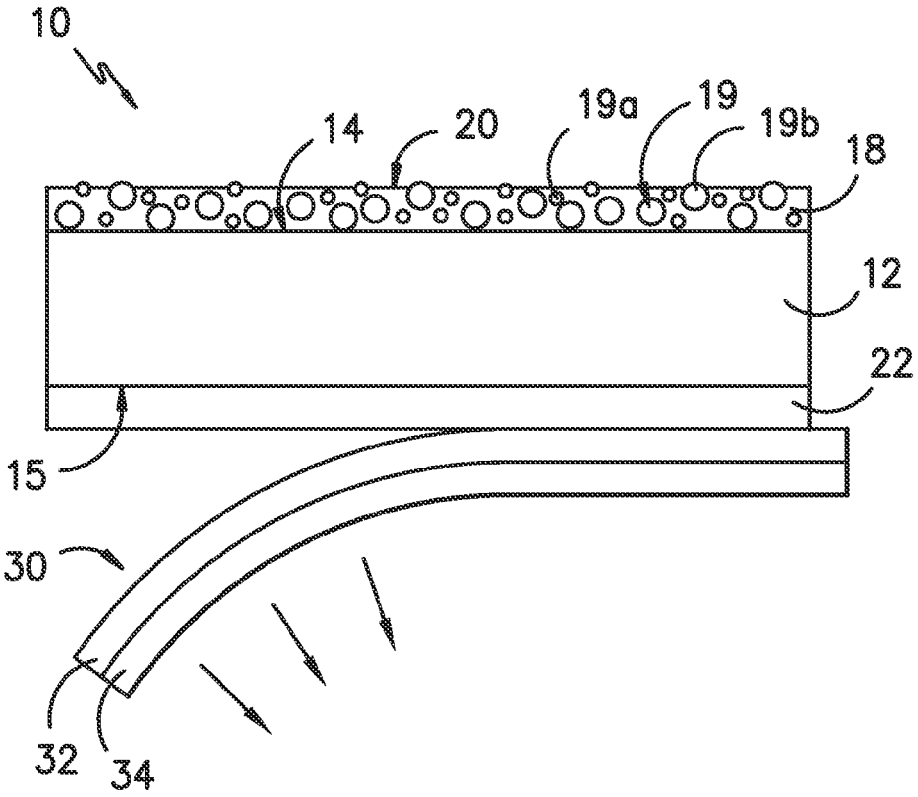
FIG. —4—

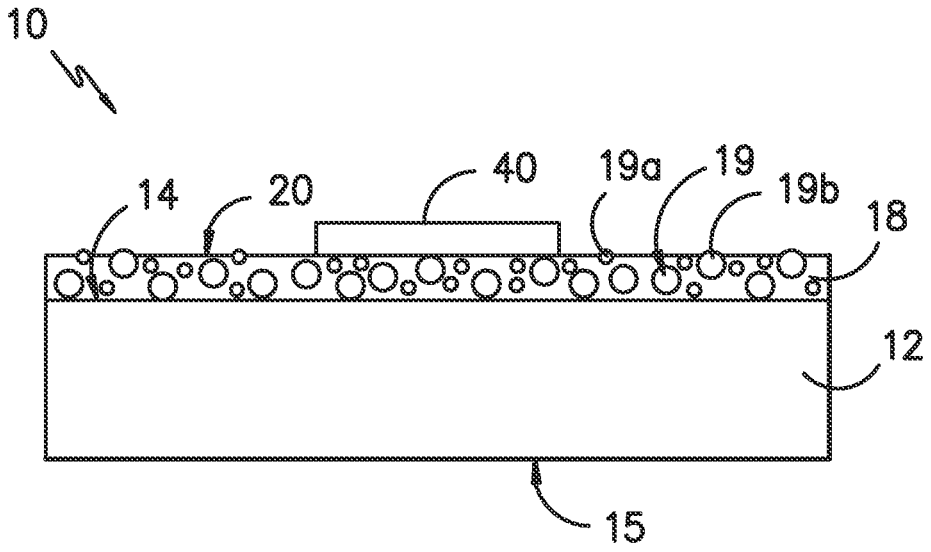
FIG. —5—
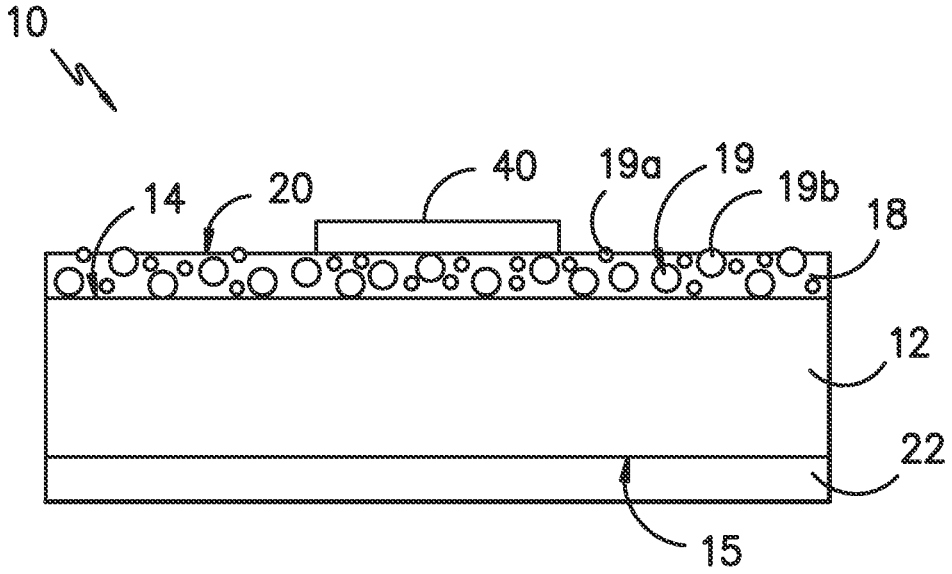
FIG. —6—

SOLVENT RESISTANT PRINTABLE SUBSTRATES AND THEIR METHODS OF MANUFACTURE AND USE

BACKGROUND OF THE INVENTION

The increased availability of printers has allowed ordinary consumers to make and print their images on a variety of papers and labels. The ink composition printed according to these processes can vary with the type of printer utilized. No matter, the inks printed onto labels can be exposed to various environments when applied to its labeled product. For example, the label can be exposed to harsh chemicals (e.g., organic solvents). This exposure to some environments can cause the ink to fade and/or be removed from the surface of the label.

Printable surfaces engineered for ink-jet printing processes are typically non-crosslinked or lightly-crosslinked polymeric layers that enable ink penetration into the printable surface during the printing process since crosslinking typically also leads to higher glass transition temperatures and less affinity of the printable layer for the ink-jet ink, leading to less durability in the printed material.

Therefore, a need exists for a substrate (e.g., a label) having improved printable characteristics and durability of printed inks on the surface of the label.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which:

FIG. 1 shows an exemplary printable substrate with a printable coating on a first surface of the base sheet;

FIG. 2 shows an exemplary printable label substrate having a printable coating on a first surface of the base sheet and an adhesive layer on the opposite surface of the base sheet (i.e., a second surface);

FIG. 3 shows the exemplary printable label substrate of FIG. 2 attached to a releasable sheet;

FIG. 4 shows removal of the releasable sheet from the exemplary printable label substrate of FIG. 2 exposing the adhesive layer; FIG. 5 shows an ink composition applied to the exemplary printable substrate 10 of FIG. 1; and FIG. 6 shows an ink composition applied to the exemplary printable substrate 10 of FIG. 2.

Repeat use of reference characters in the present specification and drawings is intended to represent the same or analogous features or elements of the present invention.

SUMMARY

Objects and advantages of the invention will be set forth in part in the following description, or may be obvious from the description, or may be learned through practice of the invention.

A printable substrate is generally provided, along with methods of its formation. In one embodiment, the printable coating includes a base sheet defining a first surface and a second surface and a printable coating on the first surface of the base sheet. The base sheet can be constructed from a cellulosic nonwoven web and a saturant. The printable coating can include a plurality of inorganic microparticles and a crosslinked material, where the crosslinked material is formed from a crosslinkable polymeric binder and a crosslinking agent.

An image can be formed on the printable substrate, such as by printing an ink composition onto the printable substrate (e.g., onto the printable coating).

The method of forming a printable substrate can include, in one embodiment, saturating a cellulosic nonwoven web with a saturant composition comprising a latex reinforcing polymer and a filler and then applying a printable coating precursor directly onto a first surface of the base sheet, where the printable coating precursor includes a plurality of inorganic microparticles, a crosslinkable polymeric binder, and a crosslinking agent. Then, the printable coating precursor can be cured on the base sheet to crosslink the crosslinkable polymeric binder.

Other features and aspects of the present invention are discussed in greater detail below.

DEFINITIONS

As used herein, the term "printable" is meant to include enabling the placement of an image on a material, especially through the use of ink-jet inks.

As used herein, the term "polymeric film" is meant to include any sheet-like polymeric material that is extruded or otherwise formed (e.g., cast) into a sheet. Typically, polymeric films do not contain discernable fibers.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The expressions "by dry weight" and "based on the dry weight of the cellulosic fibers" refer to weights of fibers, e.g., cellulosic fibers, or other materials which are essentially free of water in accordance with standard practice in the papermaking art. When used, such expressions mean that weights were calculated as though no water were present.

In the present disclosure, when a layer is being described as "on" or "over" another layer or substrate, it is to be understood that the layers can either be directly contacting each other or have another layer or feature between the layers, unless otherwise stated. Thus, these terms are simply describing the relative position of the layers to each other and do not necessarily mean "on top of" since the relative position above or below depends upon the orientation of the device to the viewer.

As used herein, the prefix "micro" refers to the micrometer scale of about 1 μm to about 1 mm (i.e., 1000 μm). For example, particles having an average diameter on the micrometer scale (e.g., from about 1 μm to about 1 mm) are referred to as "microparticles."

As used herein, the term "substantially free" means no more than an insignificant trace amount present and encompasses completely free (e.g., 0 molar % up to 0.01 molar %).

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Printable substrates (e.g., printable label substrates) are generally provided that exhibit good durability with respect to an ink-jet printing(s) on the printable substrate, even in harsh environments such as exposure to organic solvents, etc. Additionally, the print quality formed on the coated label substrates can be of excellent quality such that virtually any image can be printed on the substrates.

In particular, the printable substrates include a base sheet having a printable coating on one of its surfaces. In one particular embodiment, the printable coating is positioned directly on a surface of the base sheet, without any other layer therebetween such as a tie coating, etc. Referring to FIG. 1, an exemplary printable substrate 10 having a printable coating 18 over a first surface 14 of a base sheet 12 is generally shown. The printable coating 18 is positioned to define an exterior surface 20 of the printable substrate 10. In the embodiment, shown, the printable coating 18 is directly on the first surface 14 without any intermediate layer therebetween.

The printable coating generally includes crosslinked materials to form a printable substrate that is solvent resistant, especially to those organic solvents that may otherwise solubilize the binder in the print coating if not crosslinked. Without wishing to be bound by any particular theory, it is believed that the relatively high amount of crosslinkable polymeric binder in the printable coating allows the printable coating to sufficiently bond to the saturant of the base sheet and to yield a highly solvent resistant surface that remains printable by conventional printing processes, including ink-jet printing.

I. Base Sheet

The base sheet is generally flexible and has first and second surfaces. Suitable base sheet include, but are not limited to, cellulosic nonwoven webs and polymeric films. In addition to flexibility, the base sheet also provides strength for handling, coating, sheeting, and other operations associated with the manufacture thereof.

In one particular embodiment, the base sheet is formed from a saturated, cellulosic nonwoven web. As used herein, the term "cellulosic nonwoven web" is meant to include any nonwoven web in which at least about 50 percent by weight of the fibers present therein are cellulosic fibers. Such a web typically is prepared by air laying or wet laying relatively short fibers in an aqueous suspension to form a nonwoven web or sheet. Thus, the term includes nonwoven webs prepared from a papermaking furnish. Such furnish may include, by way of illustration, only cellulose fibers or a mixture of cellulosic fibers and noncellulosic fibers. The cellulosic nonwoven web also may contain additives and other materials, such as fillers, e.g., clay and titanium dioxide, as is well known in the papermaking art.

In many embodiments, substantially all of the fibers present in the cellulosic nonwoven web are cellulosic fibers (e.g., greater than 99% by dry weight). Sources of cellulosic fibers include, by way of illustration only, woods, such as softwoods and hardwoods; straws and grasses, such as rice, esparto, wheat, rye, and sabai; bamboos; jute; flax; kenaf; cannabis; linen; ramie; abaca; sisal; and cotton and cotton linters. In addition, the cellulosic fibers may be obtained by any of the commonly used pulping processes, such as mechanical, chemimechanical, semichemical, and chemical processes. Softwoods and hardwoods are the more commonly used sources of cellulosic fibers; the fibers may be obtained by any of the commonly used pulping processes, such as mechanical, chemimechanical, semichemical, and chemical processes. Softwoods fibers can include, by way of illustration only, longleaf pine, shortleaf pine, loblolly pine, slash pine, Southern pine, black spruce, white spruce, jack pine, balsam fir, douglas fir, western hemlock, redwood, and red cedar. Examples of hardwoods include, again by way of illustration only, aspen, birch, beech, oak, maple, eucalyptus, and gum.

In one particular embodiment, the cellulosic nonwoven web includes a combination of softwood fibers and hardwood fibers. For example, the cellulosic fiber content of the cellulosic nonwoven web can include about 25% to about 75% softwood fibers and about 25% to about 75% hardwood fibers (e.g., about 40% to about 60% softwood fibers and about 40% to about 60% hardwood fibers, such as about 45% to about 55% softwood fibers and about 45% to about 55% hardwood fibers). In another embodiment, the cellulosic nonwoven web includes substantially all softwood fibers (i.e., is substantially free from any hardwood fibers).

If present, noncellulosic fibers include, by way of illustration only, glass wool and synthetic polymer fibers, i.e., fibers prepared from thermosetting and thermoplastic polymers, as is well known to those having ordinary skill in the art. Synthetic polymer fibers typically are in the form of staple fibers. Staple fibers generally have lengths which vary from about 0.125 inch (about 0.6 cm) to as long as 8 inches (about 20 cm) or so. As a practical matter, synthetic polymer fibers, if present, typically will have lengths of from about 0.125 inch (about 0.3 cm) to about 1 inch (about 2.5 cm).

In addition to the fibers, the aqueous suspension may contain other materials as is well known in the papermaking art. For example, the suspension may contain acids and bases to control pH, such as hydrochloric acid, sulfuric acid, acetic acid, oxalic acid, phosphoric acid, phosphorous acid, sodium hydroxide, potassium hydroxide, ammonium hydroxide or ammonia, sodium carbonate, sodium bicarbonate, sodium dihydrogen phosphate, disodium hydrogen phosphate, and trisodium phosphate; alum; sizing agents, such as rosin and wax; dry strength adhesives, such as natural and chemically modified starches and gums; cellulose derivatives such as carboxymethyl cellulose, methyl cellulose, and hemicellulose; synthetic polymers, such as phenolics, latices, polyamines, and polyacrylamides; wet strength resins, such as urea-formaldehyde resins, melamine-formaldehyde resins, and polyamides;

fillers, such as clay, talc, and titanium dioxide; coloring materials, such as dyes and pigments; retention aids; fiber deflocculants; soaps and surfactants; defoamers; drainage aids; optical brighteners; pitch control chemicals; slimicides; and specialty chemicals, such as corrosion inhibitors, flame-proofing agents, and anti-tamish agents.

The cellulosic nonwoven web can be made according to any process for papermaking, such as described in U.S. Pat. No. 7,794,832, which is incorporated by reference herein.

As already stated, the cellulosic nonwoven web also includes a saturant which is present to form the saturated base sheet at a level of from about 10 to about 200 percent, based on the dry weight of the cellulosic nonwoven web. For example, the saturant may be present in the saturated cellulosic nonwoven web at a level of from about 50 to about 150 percent.

The saturant generally includes from about 50% to about 90% percent, on a dry weight basis, of a latex reinforcing polymer having a glass transition temperature of from about −40° C. to about 25° C. (e.g., from about −15° C. to about 15° C.). The glass transition temperature (Tg) may be determined by dynamic mechanical analysis (DMA) in accordance with ASTM E1640-09. A Q800 instrument from TA Instruments may be used. The experimental runs may be executed in tension/tension geometry, in a temperature sweep mode in the range from −120° C. to 150° C. with a heating rate of 3° C./min. The strain amplitude frequency may be kept constant (2 Hz) during the test. Three (3) independent samples may be tested to get an average glass transition temperature, which is defined by the peak value of the tan δ curve, wherein tan δ is defined as the ratio of the loss modulus to the storage modulus (tan δ=E"/E').

In one particular embodiment, the latex reinforcing polymer may be an vinyl acetate ethylene copolymer, a nonionic polyacrylate, a synthetic rubber polymeric material (e.g., styrene-butadiene rubber, etc.), or a mixture thereof. Generally, a vinyl acetate ethylene (VAE) copolymer is a product based on the copolymerization of vinyl acetate and ethylene in which the vinyl acetate content can range between about 60% and about 95% by weight of the total formulation, and the ethylene content ranges between about 5% and about 40% by weight of the total formulation. This product should not be confused with the ethylene vinyl acetate (EVA) copolymers in which the vinyl acetate generally range in composition from 10-40%, and ethylene can vary between 60-90% of the formulation. The VAEs are water-based emulsions, whereas EVAs are solid materials used for hot melt and plastic molding applications. VAEs offer considerable performance advantages over PVA homopolymers due to the ability to alter the glass transition temperature (Tg° C.) through the incorporation of the ethylene monomer. As ethylene content increases, Tg decreases. VAEs offer comparable runability properties to PVAs with the added benefit of significantly improved tack and adhesion under low temperature and wet conditions. VAEs also exhibit better flexibility and water resistance properties and require significantly less plasticizer.

In one embodiment, the saturant also includes a filler material, such as calcium carbonate, titanium dioxide, clay, or the like or mixtures thereof. For example, in one embodiment, the saturant can include about 10% to about 30% calcium carbonate by weight based on the dry weight of the saturated nonwoven web (e.g., about 15% to about 25%). For example, the calcium carbonate can be precipitated calcium carbonate having in a variety of shapes and sizes. In one embodiment, the calcium carbonate can have a narrow particle size distribution, such as an average diameter of about 0.4 μm to about 3 μm. A preferred powdered calcium carbonate may be obtained from the Mississippi Lime Company, Alton, Ill. 62002, and St. Genevieve, Mo. 63670. Mississippi M60 (Extra Light) Precipitated Calcium Carbonate is preferred. It is reported to have a mean particle size (sedigraph) of 0.9 microns, a BET surface are of 12.0 m2/g, a 325 mesh residue of 0.01%.

Other materials can also be included within the saturating composition, such as sizing agents, colorants, defoamers, crosslinker, optical brightener, pH adjusting chemicals, and/or buffering agents.

The saturated paper of the present invention may be made in accordance with known procedures. Briefly, and by way of illustration only, the paper may be made by preparing an aqueous suspension of fibers with at least about 50 percent, by dry weight, of the fibers being cellulosic fibers; distributing the suspension on a forming wire; removing water from the distributed suspension to form a paper; and treating the paper with the saturant. In general, the aqueous suspension is prepared by methods well known to those having ordinary skill in the art. Similarly, methods of distributing the suspension on a forming wire and removing water from the distributed suspension to form a paper also are well known to those having ordinary skill in the art.

If desired, the cellulosic nonwoven web is formed by removing water from the distributed aqueous suspension may be dried prior to the treatment of the paper with the saturant. Drying of the paper may be accomplished by any known means. Examples of known drying means include, by way of illustration only, convection ovens, radiant heat, infrared radiation, forced air ovens, and heated rolls or cans. Drying also includes air drying without the addition of heat energy, other than that present in the ambient environment.

The basis weight of the latex-saturated paper may be whatever is needed for the end use. For example, the basis weight of the latex-saturated paper may be in a range of from about 40 to about 240 gsm. Generally, a finished basis weight of about 80 grams per square meter (about 60 grams of pulp and 20 grams of saturant) is particularly suitable for use as a label.

II. Printable Coating

The printable coating can generally be applied to the base sheet (e.g., directly on a surface of the base sheet) in order to form an external, printable surface on the resulting printable substrate. Specifically, the printable coating can improve the printability of the label substrate. Additionally, any printing on the printable coating can be durable and can withstand harsh conditions (e.g., exposure to moisture and/or harsh chemical environments) and can exhibit an increased scratch and abrasion resistance.

The printable coating can act as an anchor to hold the printed image (e.g., formed by a ink-jet based ink) on the coated label substrate. Thus, the printed substrate can have increased durability in a variety of environments. In one particular embodiment, the print coating can provide a solvent resistant printable surface, particularly for organic solvents such as alcohols, kerosene, toluene, xylenes (e.g., a mixture of the three isomers of dimethylbenzene), benzene, oils, etc.

The printable coating, in one particular embodiment, includes a plurality of inorganic microparticles and a crosslinked material formed from a crosslinkable polymeric binder and a crosslinking agent. For example, the printable coating can comprise about 60% by weight to about 80% by weight of the inorganic microparticles (e.g., about 65% by weight to about 75% by weight), about 25% by weight to about 35% by weight of the crosslinkable polymeric binder (e.g., about 17% by weight to about 25% by weight), about 0.01% by weight up to 1% by weight of the crosslinking agent (e.g., about 0.01% by weight to about 0.05% by weight). In one particular embodiment, the printable coating is substantially free from a crosslinking catalyst. Each of these components is discussed in greater detail below.

The inorganic microparticle 19 can be, in one particular embodiment, a metal-oxide microparticle, such as silicon dioxide ($SiO_2$), aluminum oxide ($Al_2O_3$), aluminum dioxide ($AlO_2$), zinc oxide (ZnO), and combinations thereof. Without wishing to be bound by theory, it is believed that the inorganic microparticles 19 add affinity for the inks of the printed image to the printable coating. For example, it is believed that the metal-oxide porous microparticles (e.g., $SiO_2$) can absorb the ink liquid (e.g., water and/or other solvents) quickly and can retain the ink molecules upon drying, even after exposure to an organic solvent. Additionally, it is believe that metal-oxide microparticles (e.g., $SiO_2$) can add an available bonding site at the oxide that can bond (covalent bonds or ionic bonds) and/or interact (e.g., van der Waals forces, hydrogen bonding, etc.) with the ink binder and/or pigment molecules in the ink. This bonding and/or interaction between molecules of the ink composition and the oxide of the microparticles can improve the durability of the ink printed on the printable surface.

The inorganic microparticles 19 can have an average diameter on the micrometer (micron or μm) scale, such as from about 4 μm to about 17 μm (e.g., about 7 μm to about 15 μm). Such microparticles can provide a sufficiently large surface area to interact with the ink composition applied to the printable coating 18, while remaining sufficiently smooth on the exposed surface 20. Additionally, microparticles that are too large can lead to grainy images formed on the printable coating 18 and/or reduce the sharpness of any image applied thereto.

In one particular embodiment, the printable coating can include a first plurality of inorganic microparticles 19*a* having a first average diameter and a second plurality of inorganic microparticles 19*b* having a second average diameter, with the first average diameter being smaller than the second average diameter. For example, the first average diameter can be about 3 μm to about 12 μm (e.g., about 4 to about 10), and the second average diameter can be about 8 μm to about 15 μm (e.g., about 10 to about 14). In this embodiment, the first plurality (having smaller average diameters) can help the sharpness of any images applied to the printable coating 18, while the second plurality (having larger average diameters) can help to quickly absorb the ink into the printable coating 18.

In one particular embodiment, a higher weight percent of the first plurality of inorganic microparticles 19*a* (having smaller average diameters) can be present in the layer than the second plurality of inorganic microparticles 19*b* (having larger average diameters). It is believed, without wishing to be bound by any particular theory, that such a ratio of particles 19 can allow the crosslinkable polymeric binder to form a stronger coating through its ability to better hold the smaller particles than the larger particles. Additionally, it is believed that the larger particles can help speed up the intake and/or drying times of the ink (to prevent bleeding).

As stated, a crosslinking agent is present in the printable coating 18 to lightly crosslink the polymeric binder. In particular, the crosslinkable polymeric binder can react with the crosslinking agent to form a 3-dimensional crosslinked material around the microparticles 19 to hold and secure the microparticles 19 in place in the printable coating 18.

Generally, it is contemplated that any pair of crosslinkable polymeric binder and crosslinking agent that reacts to form the 3-dimensional polymeric structure may be utilized. Particularly suitable crosslinking polymeric binders include those that contain reactive carboxyl groups. Exemplary crosslinking binders that include carboxyl groups include acrylics, polyurethanes, ethylene-acrylic acid copolymers, and so forth. Other desirable crosslinking binders include those that contain reactive hydroxyl groups. Cross-linking agents that can be used to crosslink binders having carboxyl groups include polyfunctional aziridines, epoxy resins, carbodiimide, oxazoline functional polymers, and so forth. Cross-linking agents that can be used to crosslink binders having hydroxyl groups include melamine-formaldehyde, urea formaldehyde, amine-epichlorohydrin, multi-functional isocyanates, and so forth.

In one particular embodiment, the crosslinkable polymeric material can be an ethylene acrylic acid copolymer, such as available under as Michem Prime 4983 (Michelman), and the crosslinking agent can be an epoxy crosslinking agent, such as available under the name CR-5L (Esprix Technologies, Sarasota, Fla.).

When the printable coating is directed to applications for receiving a dye-based ink via ink-jet printing, the printable coating can further include a cationic polyelectrolyte, such as the low molecular weight, high charge density cationic polyelectrolyte available under the name GLASCOL F207 (BASF). When present, the printable coating can include about 1% by weight to about 5% by weight of the cationic polyelectrolyte.

Other additives, such as processing agents, may also be present in the printable coating, including, but not limited to, thickeners, dispersants, emulsifiers, viscosity modifiers, humectants, pH modifiers etc. Surfactants can also be present in the printable coating to help stabilize the emulsion prior to and during application. For instance, the surfactant (s) can be present in the printable coating up to about 5%, such as from about 0.1% to about 1%, based upon the weight of the dried coating. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co. of Philadelphia, Pa. In one particular embodiment, a combination of at least two surfactants can be present in the printable coating.

Viscosity modifiers can be present in the printable coating. Viscosity modifiers are useful to control the rheology of the coatings in their application. For example, sodium polyacrylate (such as Paragum 265 from Para-Chem Southern, Inc., Simpsonville, S.C.) may be included in the printable coating. The viscosity modifier can be included in any amount, such as up to about 5% by weight, such as about 0.1% to about 1% by weight.

Additionally, pigments and other coloring agents may be present in the printable coating such that the printable coating provides a background color to the printable substrate. For example, the printable coating may further include an opacifier with a particle size and density well suited for light scattering (e.g., aluminum oxide particles, titanium oxide particles, and the like). These opacifiers may be additional metal-oxide particles within the polymer matrix of the printable coating. These opacifiers can be present in the printable coating from about 0.1% by weight to about 25% by weight, such as from about 1% by weight to about 10% by weight.

When it is desired to have a relatively clear or transparent printable coating, the printable coating can be substantially free from pigments, opacifying agents, and other coloring agents (e.g., free from metal particles, metalized particles, clay particles, etc.) other than the inorganic microparticles. In these embodiments, the underlying base sheet can be seen through the printable coating, except where an image is printed on the printable coating.

In one particular embodiment, the printable coating can be formed by applying a printable coating precursor on the first surface of the base sheet, where the printable coating precursor includes the plurality of inorganic microparticles, the crosslinkable polymeric binder, and the crosslinking agent. The printable coating may be applied to the label substrate by known coating techniques, such as by roll, blade, Meyer rod, and air-knife coating procedures. The printable coating can, in one particular embodiment, be formed by applying a polymeric emulsion onto the surface of the base sheet, followed by drying. The resulting printable substrate then may be dried using. for example, steam-heated drums, air impingement, radiant heating, or some combination thereof. Alternatively, the printable coating may be a film laminated to the base sheet.

Likewise, an adhesive layer, when present, may be applied to the opposite surface of the base sheet by any technique. The printable coating precursor can then be dried and cured to crosslink the crosslinkable polymeric binder. While some heat may be applied to dry the precursor (i.e., enough heat to remove water and any other solvents), heat is not necessary for curing in particular embodiments. As such, curing can be achieved at room temperature (e.g., about 20° C. to about 25° C.). However, applying heat for curing may decrease the time required for curing of the coating. The basis weight of the printable coating generally may vary from about 2 to about 70 g/m$^2$, such as from about 3 to about 50 g/m$^2$. In particular embodiments, the basis weight of the printable coating may vary from about 5 to about 40 g/m$^2$, such as from about 7 to about 25 g/m$^2$.

As stated, the printable coating is formed directly on the surface of the base sheet in particular embodiments. In an alternative embodiment, however, a tie coating (not show) may be positioned between the base sheet and the printable coating. Such a tie coating may include a rubber latex (e.g., a styrene-butadiene latex), an acrylic latex, and a filler material (e.g., clay particles). For example, the tie coating can have a composition of, by dried weight, about 25% to about 45% of a rubber latex, about 15% to about 30% of an acrylic latex, and about 35% to about 50% of a filler material. Such a tie coating can be applied at relatively low basis weight (e.g., about 2 g/m$^2$ to about 10 g/m$^2$).

III. Printable Substrates

FIG. 1 shows an exemplary printable substrate 10 having a printable coating 18, as described above, defining an external, printable surface 20 of the printable substrate 10. The printable coating 18 is shown directly on the first surface 14 of the base sheet 12 (i.e., no intermediate layer exists between the first surface 14 of the base sheet 12 and the printable coating 18). In the embodiment of FIG. 2, an adhesive layer 22 is shown overlying the opposite, second surface 15 of the base sheet 12. Although shown with an adhesive layer 22 in FIG. 2, the printable substrate 10 can employ any available connector to attach the coated label substrate to the material/product to be labeled. Other suitable connectors include, for example, ties (e.g., wires, cords, strings, ropes, and the like), tape (e.g., the use of tape to secure the label substrate to the product), etc.

In the exemplary embodiment of FIG. 2, the adhesive layer 22 is shown in as directly overlying the second surface 15 of the base sheet 12 (i.e., no intermediate layer exists between the second surface 15 of the base sheet 12 and the adhesive layer 22). In other embodiments, however, an intermediate layer(s) could be present between the base sheet 12 and the adhesive layer 22. For example, an intermediate back coating may be present between the base sheet 12 and the adhesive layer 22 to control curl or other properties of the resulting sheet.

The adhesive layer 22 can be a pressure sensitive adhesive, a glue applied or wet adhesive, or any other type of suitable adhesive material. For example, the adhesive layer can include natural rubber, styrene-butadiene copolymers, acrylic polymers, vinyl-acetate polymers, ethylene vinyl-acetate copolymers, and the like.

FIGS. 3 and 4 show a releasable sheet 30 can be attached to the printable substrate 10 to protect the adhesive layer 22 until the printable substrate 10 is to be applied to its final surface. The releasable sheet 30 includes a release layer 32 overlying a base sheet 34. The release layer 32 allows the releasable sheet 30 to be released from the printable substrate 10 to expose the adhesive layer 22 such that the printable substrate 10 can be adhered to its final surface via the adhesive layer 22.

The base sheet 34 of the releasable sheet 30 can be any film or web (e.g., a paper web). For example, the base sheet 34 can be generally manufactured from any of the materials described above with regards to the label substrate.

The release layer 32 is generally included to facilitate the release of the releasable sheet 30 from the adhesive layer 22. The release layer 32 can be fabricated from a wide variety of materials well known in the art of making peelable labels, masking tapes, etc. Although shown as two separate layers in FIGS. 3-4, the release layer 32 can be incorporated within the base sheet 34, so that they appear to be one layer having release properties.

To apply the label to a surface, the releasable sheet is first separated from the coated label substrate to expose the adhesive layer of the coated label substrate. The releasable sheet can be discarded and the coated label substrate can be adhered to a surface via the adhesive layer.

IV. Printing onto the Printable Coating of the Printable Substrate

An image can be formed on the printable coating of the coating label substrate by printing an ink composition onto the printable coating. In particular, ink-jet printing methods can print the ink composition to the printable coating. Ink-jet inks can typically be pigment based inks (e.g., Durabrite® inks by Epson), dye-based inks (e.g., Calria® inks by Epson), water-based inks that are sublimation inks sensitive to heat but are still classified as dyes (e.g., such as available from Sawgrass Technology).

FIGS. 5-6 show an ink composition 40 on the printable coating 18 of the printable substrate 10. The ink composition can form any desired image desired on the printable coating. Typically, the composition of the ink composition will vary with the printing process utilized, as is well known in the art.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A printable substrate, comprising:

a base sheet defining a first surface and a second surface, wherein the base sheet comprises a cellulosic nonwoven web and a saturant;

a printable coating on the first surface of the base sheet, wherein the printable coating comprises a plurality of inorganic microparticles and a crosslinked material, and wherein the crosslinked material is formed from a crosslinkable polymeric binder and a crosslinking agent, and further wherein the printable coating comprises about 60% by weight to about 80% by weight of the inorganic microparticles, about 25% by weight to about 35% by weight of the crosslinkable polymeric binder, and about 0.01% by weight to about 1% by weight of the crosslinking agent, and wherein the plurality of inorganic microparticles comprises a mixture of a first plurality of first inorganic microparticles having a first average diameter and a second plurality of second inorganic microparticles having a second average diameter, wherein the first average diameter is smaller than the second average diameter.

2. The printable substrate as in claim 1, wherein the printable coating is directly on the first surface of the base sheet.

3. The printable substrate as in claim 1, wherein the cellulosic nonwoven web comprises about 25% to about 75% softwood fibers and about 25% to about 75% hardwood fibers.

4. The printable substrate as in claim 1, wherein the cellulosic nonwoven web comprises about 40% to about 60% softwood fibers and about 40% to about 60% hardwood fibers.

5. The printable substrate as in claim 1, wherein the saturant comprises a latex reinforcing polymer.

6. The printable substrate as in claim 5, wherein the latex reinforcing polymer comprises an ethylene-vinyl acetate copolymer.

7. The printable substrate as in claim 6, wherein the crosslinking agent comprises an epoxy crosslinking agent.

8. The printable substrate as in claim 5, wherein the latex reinforcing polymer has a glass transition temperature of from about −40° C. to about 25° C.

9. The printable substrate as in claim 5, wherein the saturant further comprises a filler material.

10. The printable substrate as in claim 9, wherein the filler material comprises calcium carbonate.

11. The printable substrate as in claim 1, wherein the inorganic microparticles comprise silicon dioxide microparticles.

12. The printable substrate as in claim 1, wherein the inorganic microparticles have an average diameter of from about 4 μm to about 17 μm.

13. The printable substrate as in claim 1, wherein the first average diameter is about 4 μm to about 10 μm, and wherein the second average diameter is about 10 μm to about 14 μm.

14. The printable substrate as in claim 1, wherein the printable coating comprises about 65% by weight to about 75% by weight of the inorganic microparticles, about 17% by weight to about 25% by weight of the crosslinkable polymeric binder, and about 0.01% by weight to about 1% by weight of the crosslinking agent.

15. The printable substrate as in claim 1, further comprising:

an ink composition applied to an external surface of the coated label substrate defined by the printable coating, wherein the ink composition defines an image on the external surface.

16. The printable substrate as in claim 15, wherein the ink composition comprises an ink-jet ink.

17. The printable substrate as in claim 1, further comprising:

an adhesive layer overlying the second surface of the base sheet.

18. A method of forming an image on a printable substrate, the method comprising:

printing an ink composition onto the printable substrate of claim 1.

19. The printable substrate as in claim 1, wherein the plurality of inorganic microparticles comprises a higher weight percent of the first plurality of first inorganic microparticles than the second plurality of second inorganic microparticles 19*b*.

20. The printable substrate as in claim 1, wherein the printable coating further comprises a cationic polyelectrolyte.

21. The printable substrate as in claim 1, wherein the printable coating further comprises about 1% by weight to about 5% by weight of a cationic polyelectrolyte.

22. The printable substrate as in claim 1, wherein the printable coating is substantially free from a crosslinking catalyst.

* * * * *